US010487654B2

(12) United States Patent
Zhang et al.

(10) Patent No.: US 10,487,654 B2
(45) Date of Patent: Nov. 26, 2019

(54) ANCHORING METHOD UTILIZING SELF-DRILLING AND SELF-ANCHORING EXTENDABLE ANCHOR ROD APPLICABLE TO SOFT AND WEAK COAL ROCKS

(71) Applicant: CHINA UNIVERSITY OF MINING AND TECHNOLOGY, Xuzhou (CN)

(72) Inventors: Nong Zhang, Xuzhou (CN); Changliang Han, Xuzhou (CN); Ke Yang, Xuzhou (CN); Zhengzheng Xie, Xuzhou (CN)

(73) Assignee: CHINA UNIVERSITY OF MINING AND TECHNOLOGY, Xuzhou, Jiangsu (CN)

( * ) Notice: Subject to any disclaimer, the term of this patent is extended or adjusted under 35 U.S.C. 154(b) by 9 days.

(21) Appl. No.: 15/751,411

(22) PCT Filed: Jun. 7, 2017

(86) PCT No.: PCT/CN2017/087494
§ 371 (c)(1),
(2) Date: Feb. 8, 2018

(87) PCT Pub. No.: WO2018/095014
PCT Pub. Date: May 31, 2018

(65) Prior Publication Data

US 2019/0169987 A1 Jun. 6, 2019

(30) Foreign Application Priority Data

Nov. 25, 2016 (CN) ..... 2016 1 1061728

(51) Int. Cl.
*E21D 20/00* (2006.01)
*E21D 21/00* (2006.01)

(52) U.S. Cl.
CPC ..... *E21D 20/003* (2013.01); *E21D 21/0026* (2013.01); *E21D 21/0053* (2016.01); *E21D 21/0093* (2013.01)

(58) Field of Classification Search
CPC combination set(s) only.
See application file for complete search history.

(56) References Cited

U.S. PATENT DOCUMENTS 2,829,502 A * 4/1958 Dempsey ..... E21D 20/02 405/259.6
4,188,158 A * 2/1980 Donan, Jr. ..... E21D 21/0026 405/259.3
2002/0064429 A1 5/2002 Robertson, Jr.
2016/0326873 A1* 11/2016 Skogseth ..... E21D 21/008

FOREIGN PATENT DOCUMENTS

| | | | |
|---|---|---|---|
| AU | 2007216933 | A1 | 4/2008 |
| CN | 2532240 | Y | 1/2003 |
| CN | 201459720 | U | 5/2010 |
| CN | 106337692 | A | 1/2017 |

* cited by examiner

*Primary Examiner* — Kyle Armstrong
(74) *Attorney, Agent, or Firm* — Heslin Rothenberg Farley & Mesiti PC

(57) ABSTRACT

The present invention provides a self-drilling and self-anchoring extendable anchor rod applicable to soft and weak coal rocks and an anchoring method thereof, which are suitable for supporting soft and weak coal rock mass in roadways.

2 Claims, 3 Drawing Sheets

ANCHORING METHOD UTILIZING SELF-DRILLING AND SELF-ANCHORING EXTENDABLE ANCHOR ROD APPLICABLE TO SOFT AND WEAK COAL ROCKS

CROSS REFERENCE TO RELATED APPLICATIONS

This application is a U.S. National Phase filing under 35 U.S.C. § 371(f) of International Application PCT/CN2017/087494, filed Jun. 7, 2017. PCT/CN2017/087494 claims priority from Chinese application number 201611061728.0, filed Nov. 25, 2016. The entire contents of each of these applications are hereby incorporated herein by reference.

TECHNICAL FIELD

The present invention relates to a novel anchor rod and an anchoring technique thereof, in particular to an anchoring method utilizing a self-drilling and self-anchoring extendable rod applicable to soft and weak coal rocks which is used under coal mines.

BACKGROUND ART

Anchor rod supporting is a main coal seam roadway supporting method, and can significantly improve the stress state of the surrounding rock of a roadway, improve supporting effect, reduce supporting cost, reduce workers labor intensity, and provide an effective guarantee for safe coal production. A conventional anchor rod is made of a screw-thread steel bar with a nut tray; the anchoring method is to drill a hole with a drill rod first, and then withdraw the drill rod from the hole, charge a resin anchoring agent and insert an anchor rod body into the hole sequentially, stir the resin anchoring agent with the anchor rod to generate anchoring force, and then pre-tighten up.

The conventional anchor rod and the anchoring method thereof have many problems, especially in soft and weak coal rock mass, including: (1) a hole must be additionally drilled out with a drill rod, the drill rod must be withdrawn, and then a resin anchoring agent must be charged and an anchor rod body must be inserted into the hole sequentially, resulting in more steps and waste of time; (2) the anchor rod body is a single rigid rod body, the length of the anchor rod body cannot exceed the maximum diameter of cross section of the roadway; consequently, the length of the anchor rod body often cannot meet the design requirement owing to limitation of roadway dimensions; (3) in soft and weak coal rock mass, the resin anchoring agent has poor adhesion to the loose and cracked coal rock mass, resulting in inadequate anchor bonding force; (4) the hole drilled out in soft and weak coal rock mass shrinks and deforms quickly; as a result, it may be impossible for the resin anchoring agent to be charged or the anchor rod body to be inserted into the hole, resulting in an abandoned hole. Those problems severely limit the use of anchor rod supporting technique for supporting soft and weak coal rocks.

A variety of novel anchor rods have been developed, including self-drilling and self-anchoring anchor rods and extendable anchor rods. However, among those novel anchor rods, self-drilling and self-anchoring anchor rods do not have an extension function, while extendable anchor rods do not have a self-drilling and self-anchoring function, or the anchoring method thereof is unsuitable for soft and weak coal rock mass. There is an urgent need for a novel anchor rod and a novel anchoring method that can fully overcome the above-mentioned problems.

CONTENTS OF THE INVENTION

Technical Problem

In view of the above-mentioned technical problems, the present invention puts forward a self-drilling and self-anchoring extendable anchor rod, which can realize self-drilling and self-anchoring in soft and weak coal rocks, avoids the use of any anchoring agent, can be extended without limitation, has the advantages of lag grouting, and is applicable to soft and weak coal rocks; as well as an anchoring method utilizing the self-drilling and self-anchoring extendable anchor rod.

Technical Scheme

To attain the above-mentioned technical object, the self-drilling and self-anchoring extendable anchor rod applicable to soft and weak coal rocks of the present invention is characterized in that: it comprises a drill bit, a combined rod body, and a tightening device; the head end of the combined rod body is connected to the drill bit-via female threads in the drill bit, the combined rod body comprises a plurality of intermediate rod bodies, a plurality of connecting sleeves, and a tail rod body, wherein, the plurality of intermediate rod bodies are connected together via the plurality of connecting sleeves, the tail end of the last intermediate rod body is connected to the tail rod body via a connecting sleeve, the tightening device is connected to the tail rod body through a threaded connection, and the tightening device comprises a tapered rubber plug, a tray and a nut arranged on the tail rod body sequentially.

Each of the intermediate rod bodies has connecting male threads on its head end and a composite joint consisting of connecting male threads and a hexagonal connector on its tail end, and the tail rod body has connecting male threads on its head end and tightening threads on its tail end; the intermediate rod bodies and the tail rod body have threading (e.g. steel screw threading) on their surfaces, and are hollow in the axial direction and have a grouting hole respectively; the connecting male threads on the top end and the bottom end of the intermediate rod bodies have a length of 10~150 mm, the hexagonal connector has a length of 10~80 mm, the tightening threads have a length of 30~150 mm, and the tail rod body has a length of 400~3,500 mm.

The connecting sleeve has connecting female threads matching the intermediate rod body, the connecting sleeve has a length of 40~160 mm, and the diameter of the connecting sleeve is 105~130% of the diameter of the intermediate rod body.

The tapered rubber plug has female threads of rubber plug on the inside to increase the friction with the tail rod body.

An anchoring method utilizing the self-drilling and self-anchoring extendable anchor rod applicable to soft and weak coal rocks, comprising the following steps:

a. using a drill rod to drill a hole at a designed position to ¼~¾ designed hole length, and withdrawing the drill rod; at this point, the hole may collapse partially;
b. selecting required quantity of intermediate rod bodies and connecting sleeves according to the designed hole length, utilizing the connecting sleeves to assemble the intermediate rod bodies and the tail rod body together to form an anchor rod body; mounting a drill bit to the front end of the first intermediate rod body, inserting the head end of the rod body into the hole, mounting the rear end of the rod body to a drilling apparatus and then drilling, extending the rod body utilizing the connecting sleeves and intermediate rod bodies in the drilling process, and extending the rod body with the tail rod body in the last extension, mounting the tail end of the newly combined rod body to the drilling apparatus and drilling after each extension, until the hole is drilled to its entire length; since the anchor rod body formed by the intermediate rod bodies and the connecting sleeves having threading (e.g. steel screw threading) on their surfaces, which does not have a dust discharge function; therefore, no coal dust or rock dust is discharged in the drilling process, and a great deal of coal and rock dust exists between the self-drilling section and the rod body of the anchor rod for drilling hole; thus, end anchoring force is generated at the end of the rod body owing to friction, and, in the shallow ¼~¾ section of the hole, since the hole drilled out in soft and weak coal rock mass collapses, shrinks and deforms quickly, the rod body is pressed to generate anchoring force;

c. shutting down the drilling apparatus when the exposed length of the tail rod body is 30~150 mm, separating the drilling apparatus from the tail rod body, fitting the tapered rubber plug and the tray over the tightening threads on the tail end of the tail rod body sequentially, and tightening the nut for post-tensioning, so that the self-drilling and self-anchoring extendable anchor rod squeezes the coal mass and is embedded in the coal mass, and thereby the friction force between the self-drilling and self-anchoring extendable anchor rod and the coal mass is increased; thus, a primary installation is finished;

d. at 1 h~2 h after construction, the hole collapse, shrinkage and deformation are developed more fully and the anchoring force is higher; then, tightening up the nut with a wrench for secondary post-tensioning; such tightening can also prevent prestress relaxation of the self-drilling and self-anchoring extendable anchor rod incurred by construction of other self-drilling and self-anchoring extendable anchor rods nearby;

e. at 12~24 h after construction, underground worker checking the post-tensioning force on the self-drilling and self-anchoring extendable anchor rod with a torque-indicating wrench, and post-tensioning up the self-drilling and self-anchoring extendable anchor rod again if the post-tensioning force does not meet the requirement, so as to maintain the post-tensioning force.

The diameter of the drill bit in the initial drilling process exceeds the diameter of the body of the self-drilling and self-anchoring extendable anchor rod by 1~10 mm.

Benefits: With the technical scheme described above, the present invention has the following advantages over the prior art:

a. the total length of the anchor rod body can be adjusted at any time according to the on-site requirement to match with the hole of any depth by combining and expanding the connecting sleeves and the intermediate rod bodies according to the actual depth of the hole; thus, the actual operation is highly flexible, the connections are tight, and a self-drilling and self-anchoring function is realized with the drill bit arranged at the head end;

b. the hole is formed in a semi self-drilling manner, and the hole drilling procedure and the anchor rod mounting procedure are combined into one procedure; thus, the construction time of a single anchor rod is shortened, while there is no need to worry about hole abandon incurred by hole collapse, the construction time is saved and the construction efficiency is improved;

c. no explosive cartridge is used; instead, anchoring force is formed by means of squeezing and rubbing the rod body depending on the coal and rock dust and quick shrinkage and deformation of the hole; thus, a good anchoring effect is attained, and a defect of explosive cartridge insertion failure incurred by hole collapse and poor anchorage of explosive cartridge in the soft and weak coal-rock mass is eliminated;

d. in the construction process with the novel anchor rod, the anchor rod is extended while the drilling work is continued; thus, the final length of the anchor rod is not limited to the diameter of the roadway.

In the figures: 1—drill bit; 2—intermediate rod bodies; 3—connecting sleeve; 4—tail rod body; 5—tapered rubber plug; 6—tray; 7—nut; 8—grouting hole; 9—connecting male thread; 10—hexagonal connector; 11—female thread of drill bit; 12—connecting female thread; 13—tightening thread; 14—female thread of rubber plug.

EMBODIMENTS

Hereunder the present invention will be further detailed with reference to the accompanying drawings and examples.

The mechanical structure of the self-drilling and self-anchoring extendable anchor rod is described as follows.

Figure 1:
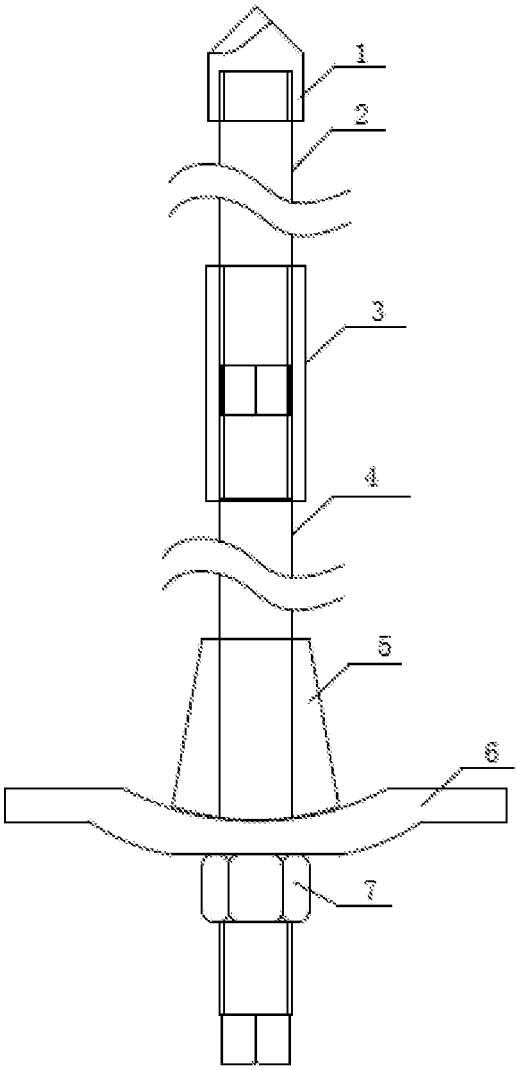
FIG. 1 is a schematic assembly diagram of the anchor rod of the present invention.

As shown in FIG. 1, the self-drilling and self-anchoring extendable anchor rod applicable to soft and weak coal rocks of the present invention comprises a drill bit 1, a combined rod body, and a tightening device; the combined rod body comprises a plurality of intermediate rod bodies 2, a plurality of connecting sleeves 3, and a tail rod body 4, wherein, the plurality of intermediate rod bodies 2 are connected together via the plurality of connecting sleeves 3, the tail end of the last intermediate rod body 2 is connected to the tail rod body 4 via a connecting sleeve 3. FIG. 1 shows the situation in which one intermediate rod body 2 is used. The tightening device is connected to the tail rod body 4 through a threaded connection, and the tightening device comprises a tapered rubber plug 5, a tray 6 and a nut 7 arranged on the tail rod body sequentially.

Figure 2:
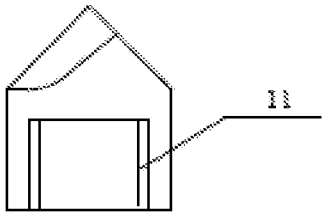
FIG. 2 is a structural diagram of the drill bit of the present invention.

FIG. 2 is a structural diagram of the drill bit 1. Connecting female threads 12 are arranged within drill bit 1.

Figure 3:
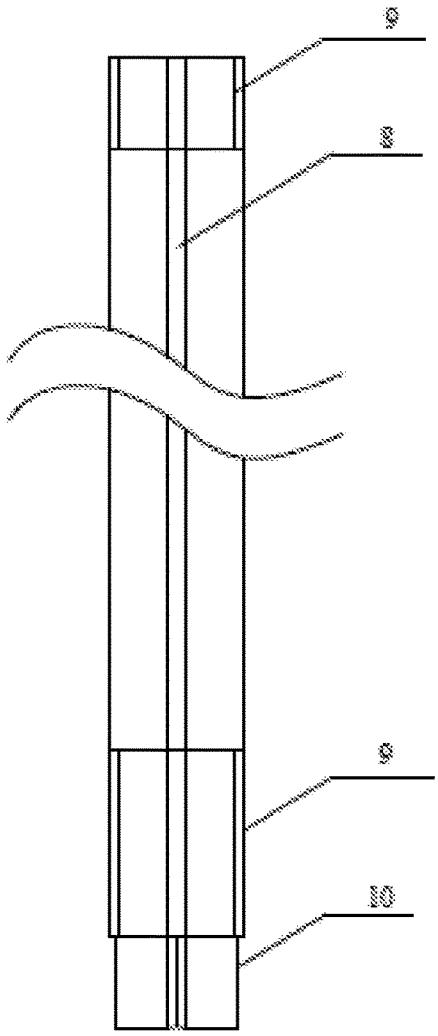
FIG. 3 is a structural diagram of the intermediate rod bodies of the present invention.
Figure 5:
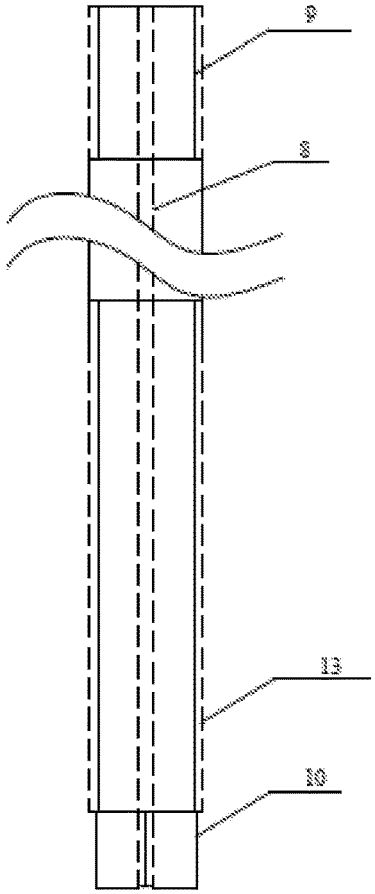
FIG. 5 is a structural diagram of the tail rod body of the present invention.

As shown in FIGS. 3 and 5, each of the intermediate rod bodies 2 has connecting male threads 9 on its head end and a composite joint consisting of connecting male threads 9 and a hexagonal connector 10 on its tail end, and the tail rod body 4 has connecting male threads 9 on its head end and tightening threads 13 on its tail end; the intermediate rod bodies 2 and the tail rod body 4 have threading (e.g. steel screw threading) on their surfaces, and are hollow in the axial direction and have a grouting hole 8 respectively; the connecting male threads 9 on the top end and the bottom end of the intermediate rod bodies 2 have a length of 10~150 mm, the hexagonal connector 10 has a length of 10~80 mm, the tightening threads 13 have a length of 30~150 mm, and the tail rod body 4 has a length of 400~3,500 mm.

Figure 4:
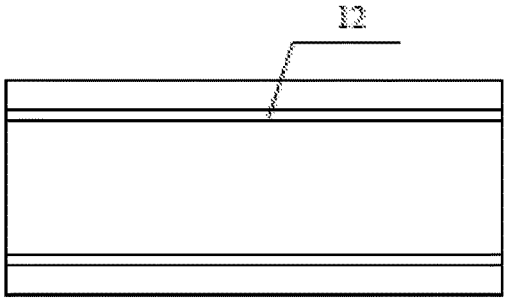
FIG. 4 is a structural diagram of the connecting sleeve of the present invention.

As shown in FIG. 4, the connecting sleeve 3 has connecting female threads 12 matching the intermediate rod body 2, the connecting sleeve 3 has a length of 40~160 mm, and the diameter of the connecting sleeve 3 is 105~130% of the diameter of the intermediate rod body 2.

Figure 6:
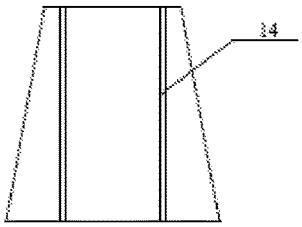
FIG. 6 is a structural diagram of the tapered rubber plug of the present invention.
Figure 7:
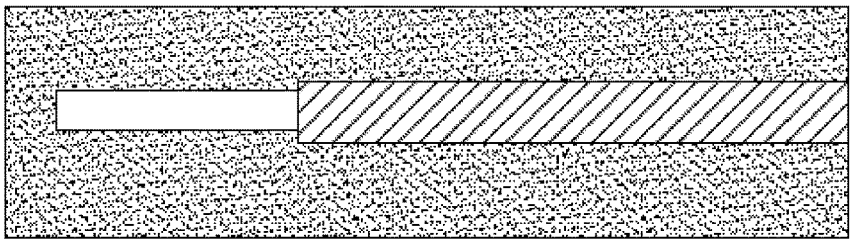
FIG. 7 is a schematic diagram of the drilled hole of the present invention.

As shown in FIG. 6, the tapered rubber plug 5 has female threads of rubber plug 14 on the inside to increase the friction with the tail rod body 4.

The length of each section of rod body is arranged to be within a range of 400~1,600 mm, so as to control the total length of the assembled anchor rod while avoiding frequent extension because each section of rod body is too short; to ensure good connection while avoiding waste of material and time resulted from excessively long extension sections, the connecting male threads on the top end and the bottom end of the intermediate rod bodies have a length of 15~100 mm, the hexagonal connector has a length of 10~35 mm, the connecting sleeve has a length of 50~150 mm, and the tightening threads have a length of 30~150 mm.

The outer diameter of the drill bit 1 is greater than the diameter of the anchor rod body by 3~8 mm, the drill bit 1 has an opening connected with the rod body, a plurality of sharp knives that protrude and are inclined to the center are arranged around the opening, the top of each sharp knife is at 3~5 mm from the center of the drill bit, spiral grooves configured to discharge the dust or debris produced during drilling from the drill bit are arranged on the side surface of the drill bit 1, and the spiral grooves have a width of 5~8 mm and a depth of 3~5 mm. A plurality of pawls are arranged at the clearance between the grooves on the side surface of the drill bit 1, and each pawl comprises a groove cavity, a circular shaft, a high-strength baffle plate and a strong spring, wherein, the groove cavity provides a space for rotation of the high-strength baffle plate, the bottom side of the groove cavity is movably connected with the high-strength baffle plate via the circular shaft, the strong spring is arranged between the high-strength baffle plate and the bottom of the groove cavity, the high-strength baffle plate is ejected by the strong spring and can rotate within the groove cavity via the circular shaft.

An anchoring method utilizing the self-drilling and self-anchoring extendable anchor rod applicable to soft and weak coal rocks, comprising the following steps:

a. using a drill rod to drill a hole at a designed position to ¼~¾ designed hole length, and withdrawing the drill rod; at this point, the hole may collapse partially;

b. selecting required quantity of intermediate rod bodies 2 and connecting sleeves 3 according to the designed hole length, utilizing the connecting sleeves to assemble the intermediate rod bodies 2 and the tail rod body 4 together to form an anchor rod body; the assembling and drilling process is as follows: mounting a—drill bit 1 to the front end of the first intermediate rod body 2, inserting the head end of the rod body into the hole, mounting the rear end of the rod body to a drilling apparatus and then drilling, extending the rod body utilizing the connecting sleeves 3 and intermediate rod bodies 2 in the drilling process, and extending the rod body with the tail rod body 4 in the last extension, mounting the tail end of the newly combined rod body to the drilling apparatus and drilling after each extension, until the hole is drilled to its entire length; since the anchor rod body formed by the intermediate rod bodies 2 and the connecting sleeves 3 having threading (e.g. steel screw threading) on their surfaces, which does not have a dust discharge function, therefore, no coal dust or rock dust is discharged in the drilling process, and a great deal of coal and rock dust exists between the self-drilling section and the rod body of the anchor rod for drilling hole; thus, end anchoring force is generated at the end of the rod body owing to friction, and, in the shallow ¼~¾ section of the hole, since the hole drilled out in soft and weak coal rock mass collapses, shrinks and deforms quickly, the rod body is pressed to generate anchoring force;

c. shutting down the drilling apparatus when the exposed length of the tail rod body 4 is 30~150 mm, separating the drilling apparatus from the tail rod body 4, fitting the tapered rubber plug 5, the tray 6 and the nut 7 over the tightening threads 13 on the tail end of the tail rod body 4 sequentially, and tightening up the nut for post-tensioning; thus, a primary installation is finished;

d. at 1~2 h after construction, the hole collapse, shrinkage and deformation are developed more fully and the anchoring force is higher; then, tightening up the nut with a wrench for secondary post-tensioning; such tightening can also prevent prestress relaxation of the self-drilling and self-anchoring extendable anchor rod incurred by construction of other self-drilling and self-anchoring extendable anchor rods nearby;

e. at 12~24 h after construction, underground worker checking the post-tensioning force on the self-drilling and self-anchoring extendable anchor rod with a torque-indicating wrench, and post-tensioning up the self-drilling and self-anchoring extendable anchor rod again if the post-tensioning force does not meet the requirement, so as to maintain the post-tensioning force.

The invention claimed is:

1. An anchoring method utilizing a self-drilling and self-anchoring extendable anchor rod applicable to soft and weak coal rocks, comprising:

drilling a hole at a designed position to be from ¼-¾ of a designed hole length;

selecting an intermediate rod body having a head, a body, and a tail end;

wherein the head and the tail end have male threading and the body has external threading;

selecting a connecting sleeve having internal female threading and external threading;

selecting a tail rod body having a head, a body, and a tail end;

wherein the head and the tail end have male threading and the body has external threading;

selecting a drill bit, having an aperture with female threading and engaging the male threading of the intermediate rod body with the female threading, thereby inserting the head end of the intermediate rod body into the aperture;

connecting a drilling apparatus by mounting the tail end of the intermediate rod body into the drilling apparatus, and drilling into the hole;

disconnecting the drilling apparatus, extending the intermediate rod body into the hole by combining a plurality of connecting sleeves to connect a plurality of intermediate rod bodies, connecting the drilling apparatus after each sleeve and intermediate rod body is attached, drilling into the hole, and repeating until the plurality of intermediate rod bodies and the plurality of sleeves extends to near the designed hole length;

connecting the tail rod body to a last connecting sleeve of the plurality of connecting sleeves, the plurality of intermediate rod bodies, and the drill bit to form a combined rod body;

connecting the tail rod body to the drilling apparatus to drill the combined rod body into the hole until the designed hole length is reached and the exposed length of tail rod body is from 30 mm-150 mm;

the external threading on the plurality of intermediate rod bodies and the external threading on the plurality of sleeves having a limited dust discharge function within the hole and promoting a frictional anchoring force at the drill bit end, promoting hole enclosure wall collapse, engaging with enclosure wall material and dust within the hole, and resulting in a radial anchoring force axially along the combined rod body;

fitting a tightening device on the tail rod body, the tightening device comprising a tapered rubber plug, a tray, and a nut;

wherein the tapered rubber plug, the tray, and the nut are fitted sequentially over tail end of the tail rod body and the nut undergoes a first tightening;

performing a second tightening on the nut from 1 hour to 2 hours after the first tightening, to mitigate stress relaxation of the combined rod body;

using a torque wrench to measure tension on the nut from 12 to 24 hours after the first tightening and if tension is below a threshold tension, performing a third tightening to meet the threshold tension.

2. The method of claim 1, wherein the diameter of a drill bit in the initial drilling process exceeds the diameter of the combined rod body by 1 mm-10 mm.

* * * * *